US006249201B1

(12) United States Patent
Lu

(10) Patent No.: US 6,249,201 B1
(45) Date of Patent: Jun. 19, 2001

(54) FLY BACK TRANSFORMER

(75) Inventor: Shao-An Lu, Pa-Te (TW)

(73) Assignee: Darfon Electronics Corp., Taoyuan (TW)

( * ) Notice: Subject to any disclaimer, the term of this patent is extended or adjusted under 35 U.S.C. 154(b) by 0 days.

(21) Appl. No.: 09/471,539

(22) Filed: Dec. 23, 1999

(30) Foreign Application Priority Data

Nov. 23, 1999 (TW) ..... 88219918

(51) Int. Cl.[7] ..... H01F 27/06; H01F 27/28
(52) U.S. Cl. ..... 336/65; 336/192; 336/195
(58) Field of Search ..... 336/195, 192, 336/173, 65

(56) References Cited

U.S. PATENT DOCUMENTS 3,622,100 * 11/1971 Wright ..... 242/125.2
3,663,914 * 5/1972 Lane ..... 336/192
3,701,961 * 10/1972 Folk ..... 336/192
6,010,362 * 1/2000 Caviness et al. ..... 439/567

* cited by examiner

*Primary Examiner*—Anh Mai
(74) *Attorney, Agent, or Firm*—Ladas & Parry

(57) ABSTRACT

A fly back transformer includes a main body, a collecting element and a wire. The collecting element is fixed to the main body, while the wire is connected to the main body via the collecting element. The collecting element or the main body has a fixing portion. The wire is fixed to the collecting element or the main body by the fixing portion to prevent a separation between the wire and the collecting element.

12 Claims, 11 Drawing Sheets

FLY BACK TRANSFORMER

BACKGROUND OF THE INVENTION

1. Field of the Invention

The present invention relates in general to a fly back transformer. In particular, the present invention relates to a means for fixing a fly back transformer.

2. Description of the Related Art

A fly back transformer (FBT) is provided on the rear of a television or monitor to transform the voltage of an external power into the required voltage for the cathode-ray tube of the television or monitor. Referring to FIG. 1, a conventional fly back transformer has a collecting element 11 and a main body 12. The collecting element 11 has three tubes 113, 114, 115 arranged in parallel, while the main body 12 has three sleeves 123, 124, 125 corresponding to the tubes 113, 114, 115. The process of assembling the fly back transformer is as follows: A high voltage wire 16, a focus wire 17 and a screen wire 18 are respectively inserted into the tubes 113, 114, 115 as shown in FIG. 2A. Then, the tubes 113, 114, 115 are inserted into the sleeves 123, 124, 125 so that the wires 16, 17, 18 electrically contact the main body 12, as shown in FIG. 2B.

Friction exists between the wires 16, 17, 18 and the tubes 113, 114, 115 as well as between the tubes 113, 114, 115 and the sleeves 123, 124, 125 to prevent the assembled fly back transformer from separating. However, the friction is not great. A pull on the wires possibly separates the assembled fly back transformer so that the workers in the production lines of factories need to reassemble the separated fly back transformer. That is a burden on the workers.

Taiwanese patent No. 278764 provides an engaging element to fix the main body 12 and the collecting element 11 together. This arrangement does solve the problem of the separation between the main body 12 and the collecting element 11 arising from a pull on the wires. However, this arrangement does not solve the problem of the separation between the wires 16, 17, 18 and the collecting element 11.

SUMMARY OF THE INVENTION

An object of the present invention is to provide a fly back transformer, in which the wires and the collecting element do not separate when a pull is applied on the wires.

The fly back transformer of the present invention includes a main body, a collecting element and at least one wire. The collecting element is fixed to the main body. Furthermore, the collecting element has a fixing portion. The wire is connected to the main body via the collecting element. Furthermore, the wire is fixed to the collecting element by the fixing portion to prevent a separation between the wire and the collecting element.

Alternatively, the fly back transformer of the present invention includes a main body and at least one wire. The main body has a fixing portion. The wire is fixed to the main body by the fixing portion.

The above-mentioned fixing portion is, for example, hook-shaped or pincers-shaped or is a protrusion.

BRIEF DESCRIPTION OF THE DRAWINGS

The present invention can be more fully understood by reading the subsequent detailed description and examples with references made to the accompanying drawings, wherein.

DETAILED DESCRIPTION OF THE PREFERRED EMBODIMENT

Figure 1:
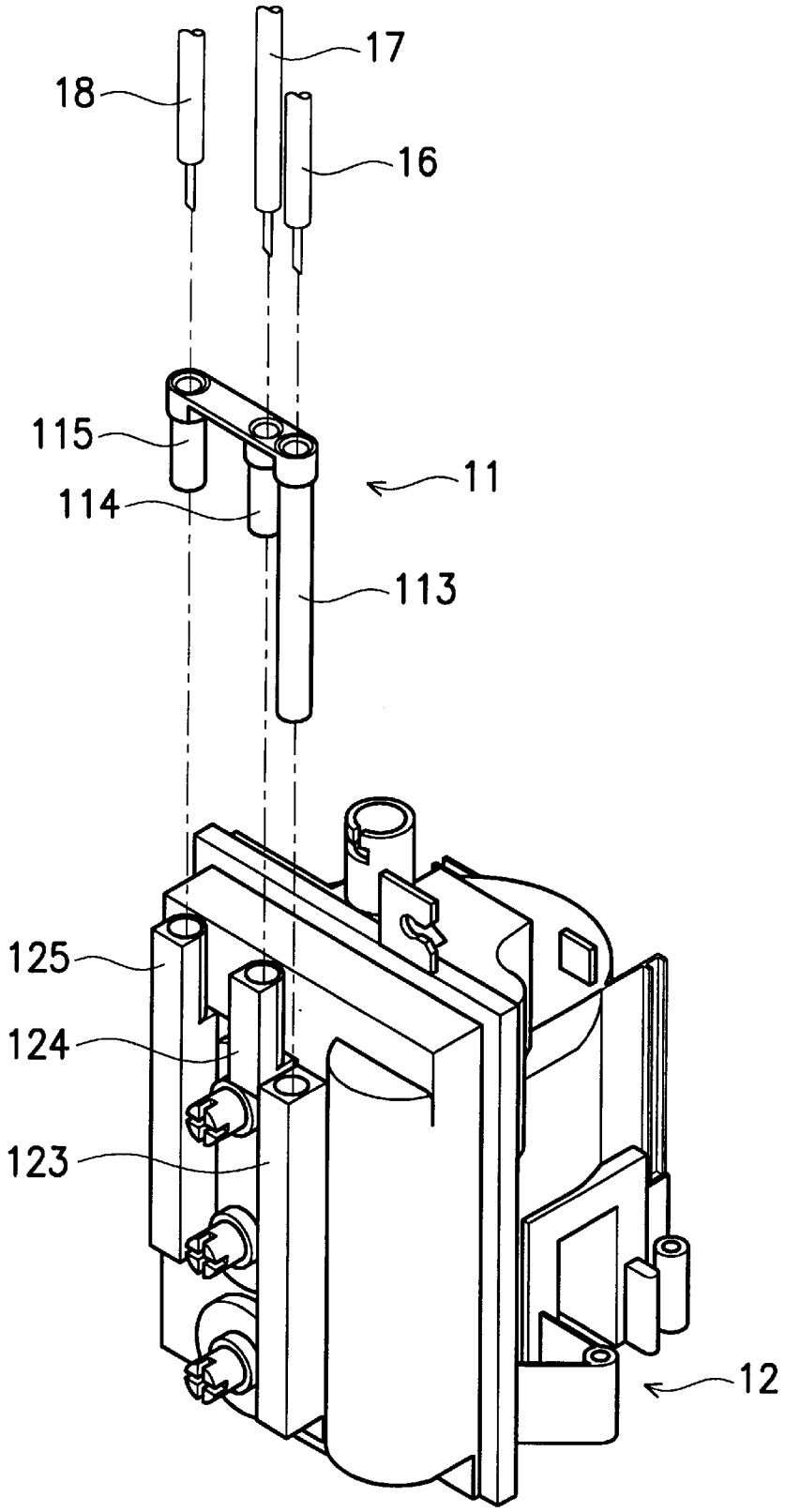
FIG. 1 (PRIOR ART)
FIG. 1 is a perspective exploded diagram of a conventional fly back transformer.
Figure 2A:
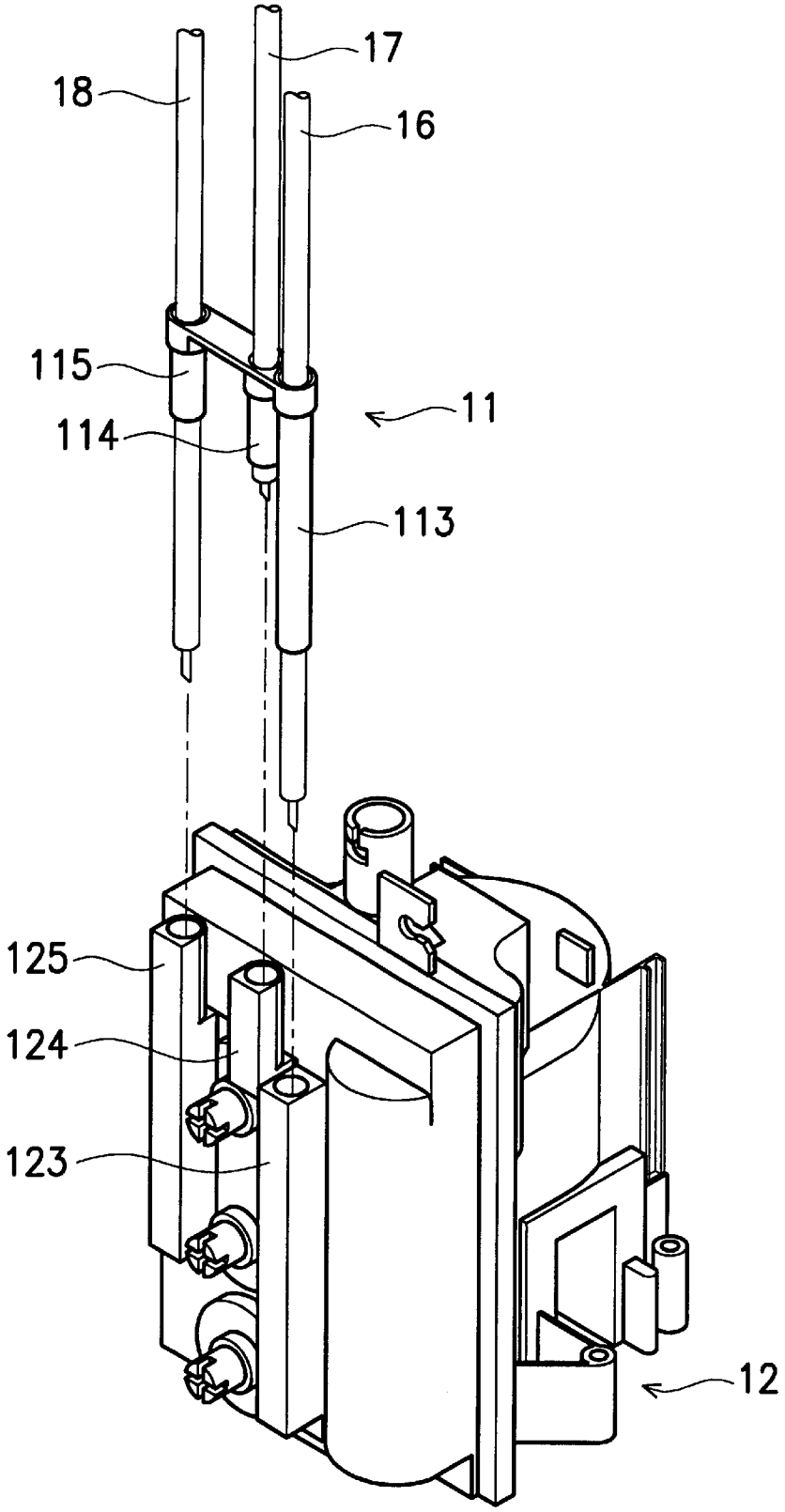
FIG. 2A (PRIOR ART)
FIGS. 2A and 2B show the process of assembling a conventional fly back transformer.
Figure 2B:
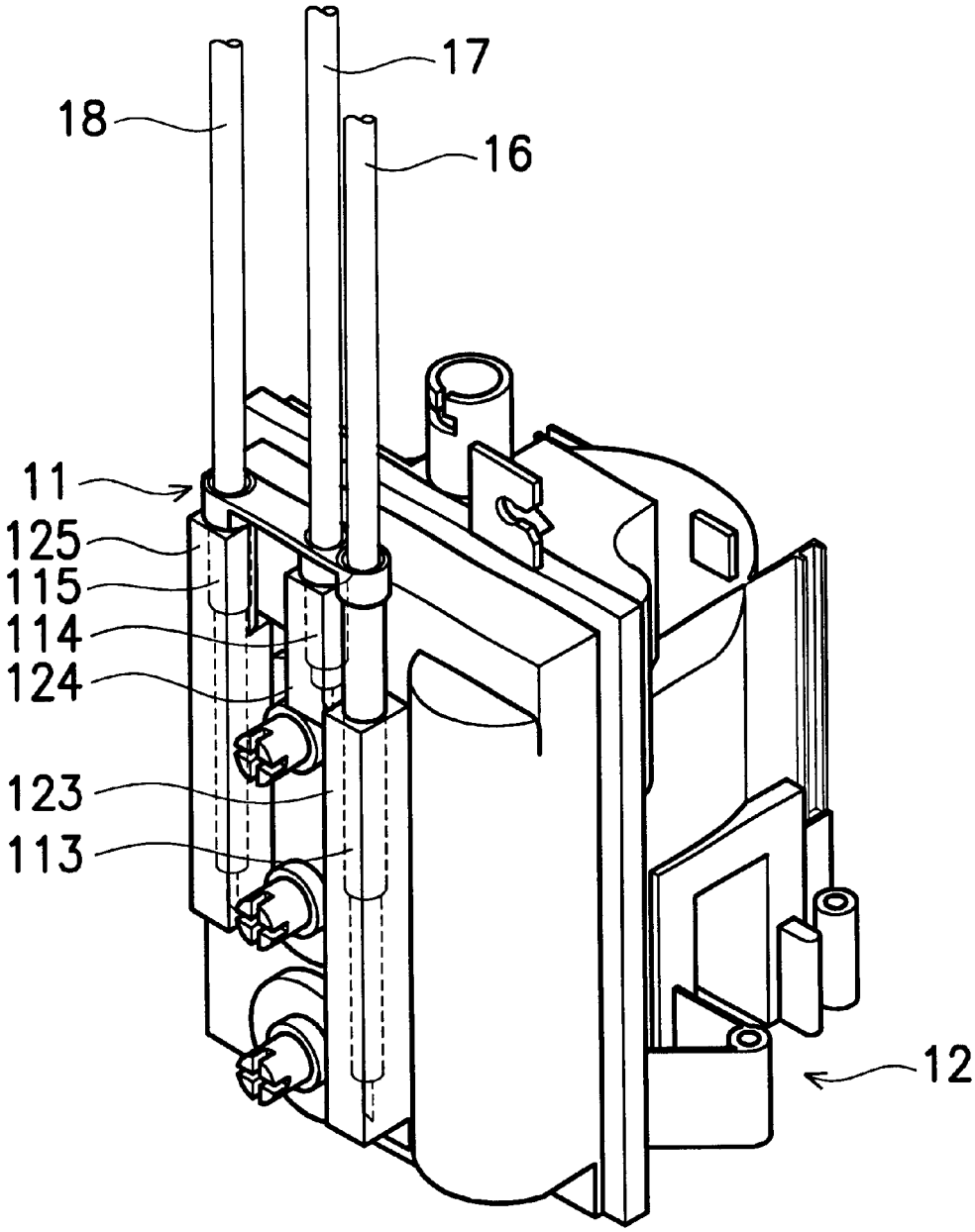
FIG. 2B (PRIOR ART)
Figure 3:
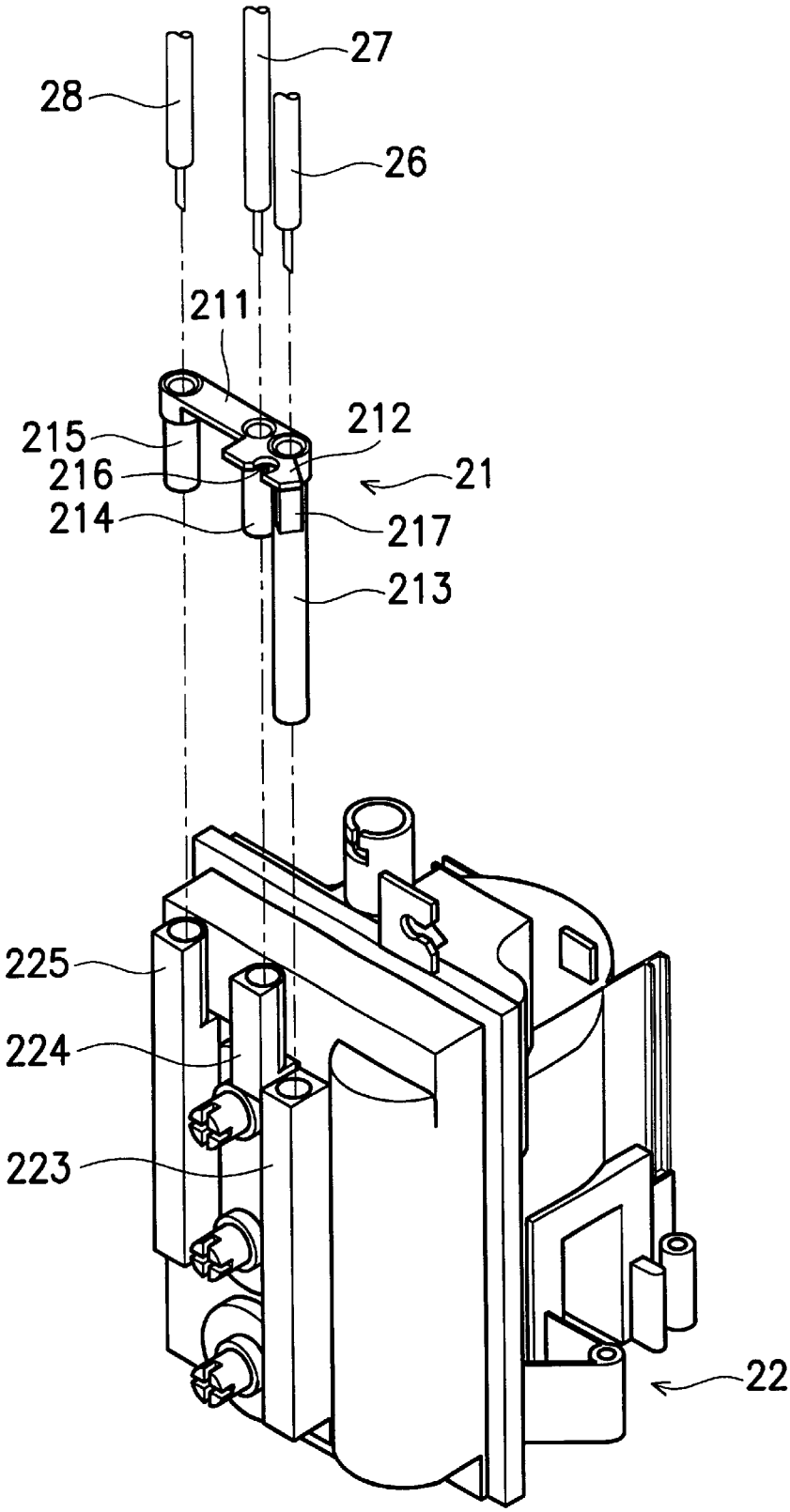
FIG. 3 is a perspective exploded diagram of a fly back transformer in accordance with a first embodiment of the present invention.

Referring to FIG. 3, a fly back transformer of a first embodiment of the present invention has a collecting element 21 and a main body 22. The main body 22 has three sleeves 223, 224, 225. The collecting element 21 has three tubes 213, 214, 215 arranged in parallel and an elongated plate 211 connecting the tubes 213, 214, 215. A protrusion 212 is formed at an end of the plate 211 and aside the tube 213. A retaining portion 217 extends downward from the protrusion 212 and is spaced apart from the tube 213. Furthermore, an opening 216 is provided on the protrusion 212.

Figure 4A:
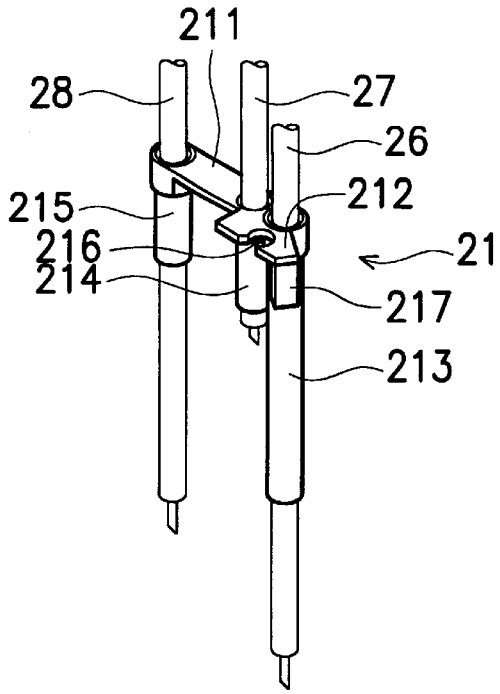
FIGS. 4A, 4B and 4C show the process of assembling a fly back transformer of the first embodiment of the present invention.
Figure 4B:
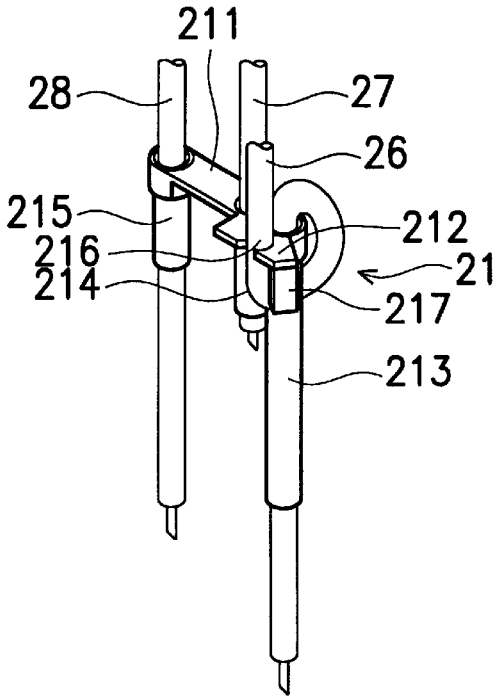
Figure 4C:
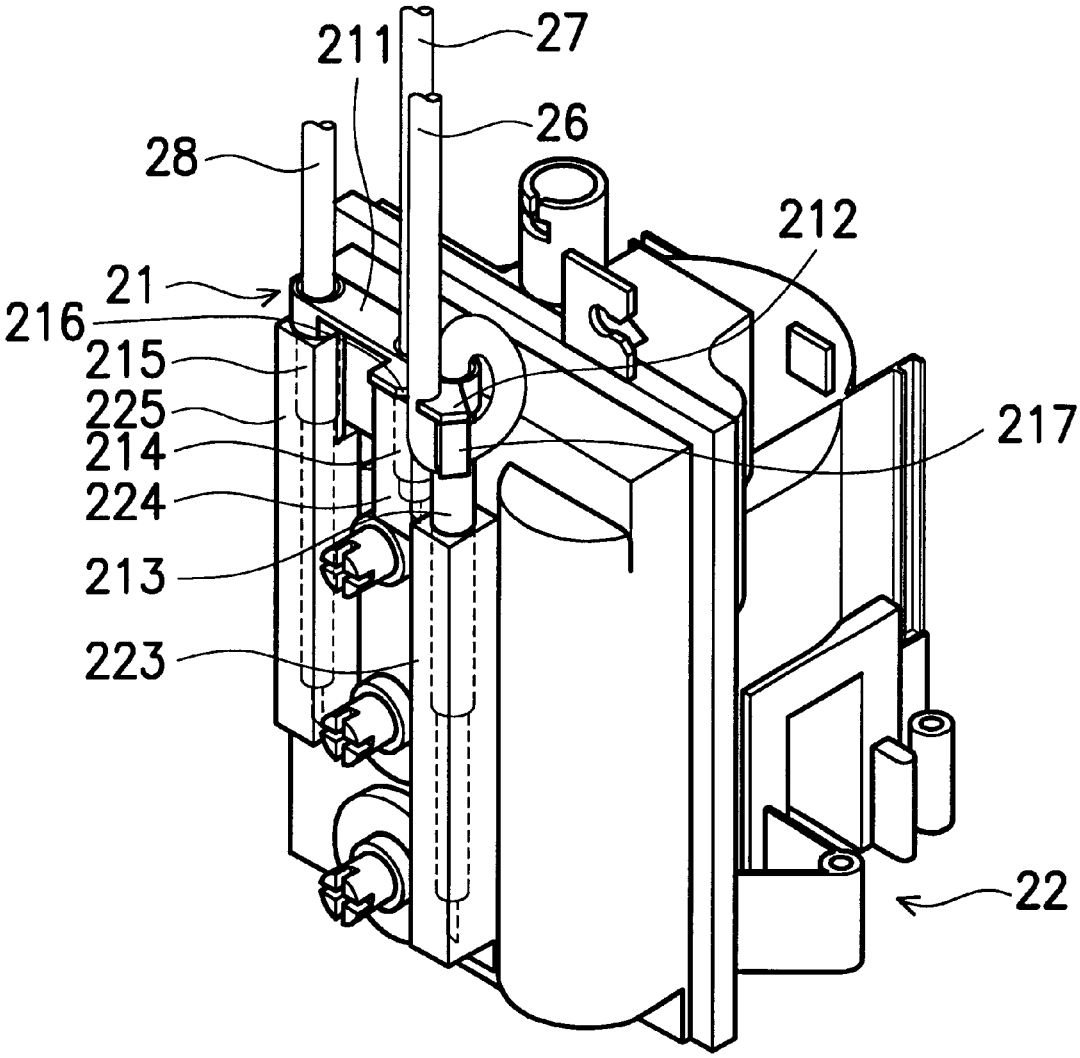

The process of assembling the fly back transformer is as follows: A high voltage wire 26, a focus wire 27 and a screen wire 28 are respectively inserted into the tubes 213, 214, 215 of the collecting element 21 as shown in FIG. 4A. Then, the high voltage wire 26 is twined around the protrusion 212 and a portion of the high voltage wire 26 is pushed into the opening 216 as shown in FIG. 4B. Then, the tubes 213, 214, 215 of the collecting element 21 are inserted into the sleeves 223, 224, 225 of the main body 22 so that the wires 26, 27, 28 electrically contact the main body 22 as shown in FIG. 4C. By this arrangement, the high voltage wire 26 does not separate from the tube 213 of the collecting element 21 when the worker carelessly pulls the high voltage wire 26. Furthermore, the retaining portion 217 stops the high voltage wire 26 from laterally moving, thus keeping the high voltage wire 26 around the protrusion 212.

Figure 5:
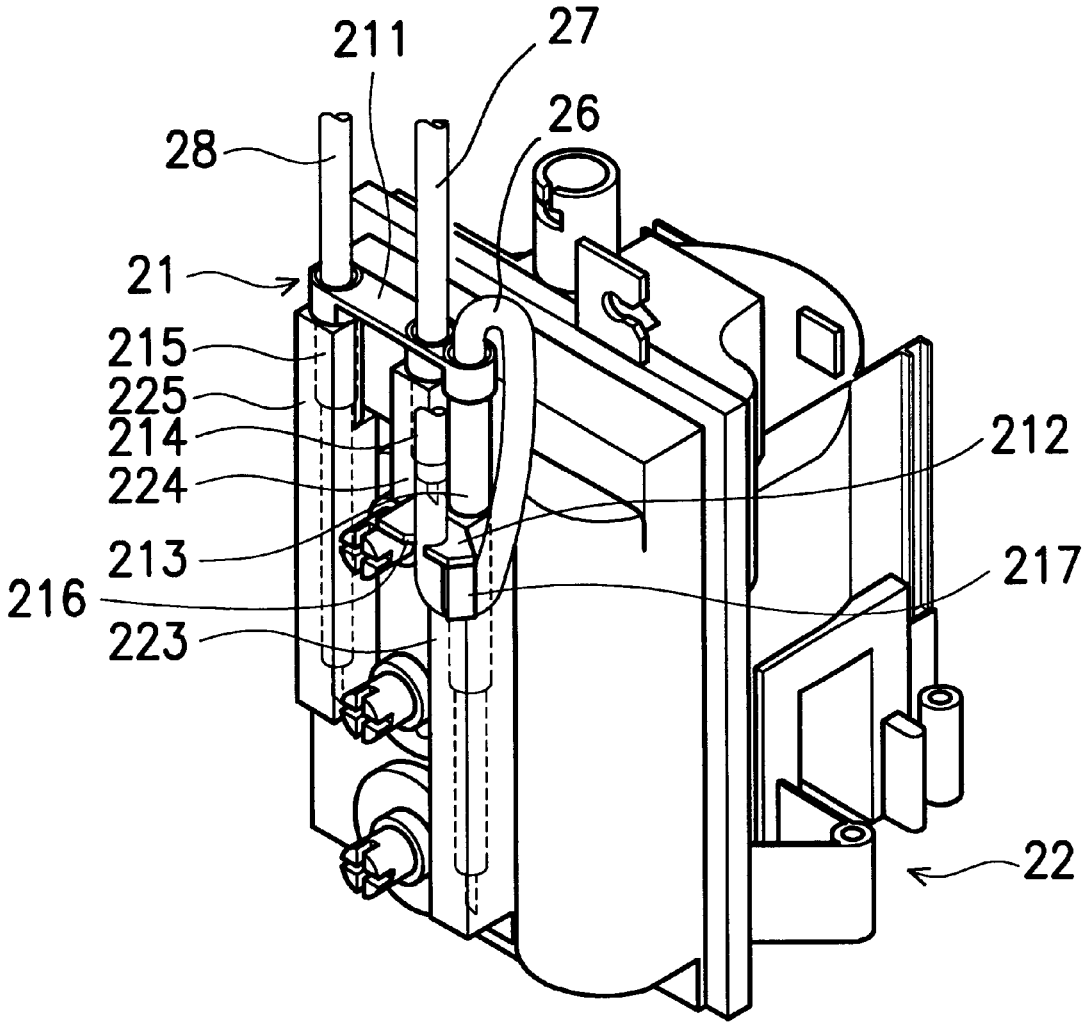
FIG. 5 shows a modified example of the first embodiment.

Similarly, the first embodiment can be modified by providing other protrusions on the plate 211 aside the tubes 214, 215 to prevent the separation of the focus wire 27 and screen wire 28 from the tubes 214, 215. Referring to FIG. 5, another modified example is to form the above-mentioned protrusion 212 on the sleeve 223 of the main body 22 instead of the collecting element 21 to fix the wires 26.

Figure 6:
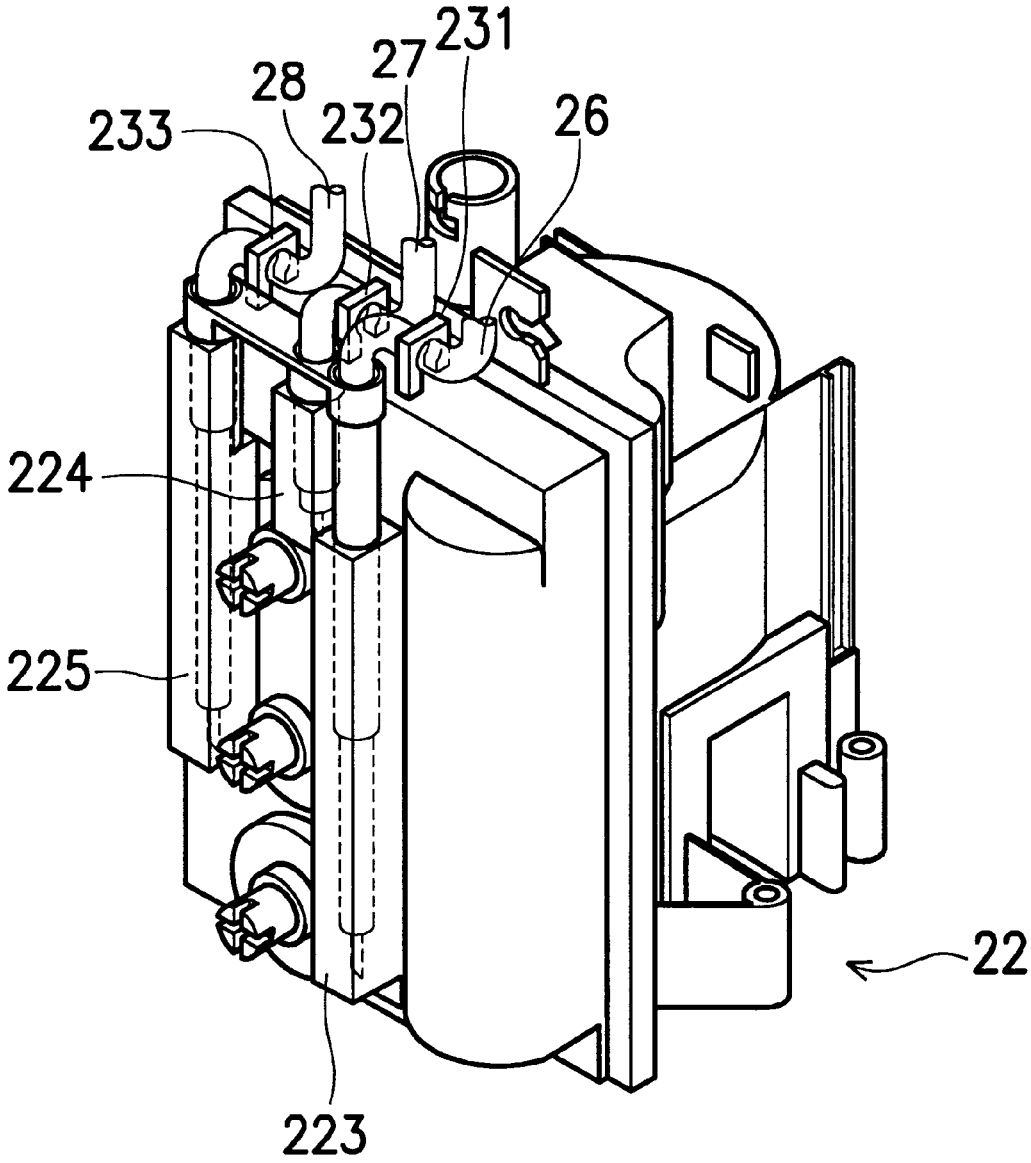
FIG. 6 is a perspective exploded diagram of a fly back transformer in accordance with a second embodiment of the present invention.

FIG. 6 shows a fly back transformer of a second embodiment of the present invention, in which the same elements as those in the first embodiment are indicated by the same reference numbers to omit the description thereof. In the second embodiment, hook-shaped portions 231, 232, 233 are formed on the main body 22 to hook the high voltage wire 26, the focus wire 27 and the screen wire 28, respectively. Thus, a pull on the wires 26, 27, 28 does not separate them from the fly back transformer.

Figure 7:
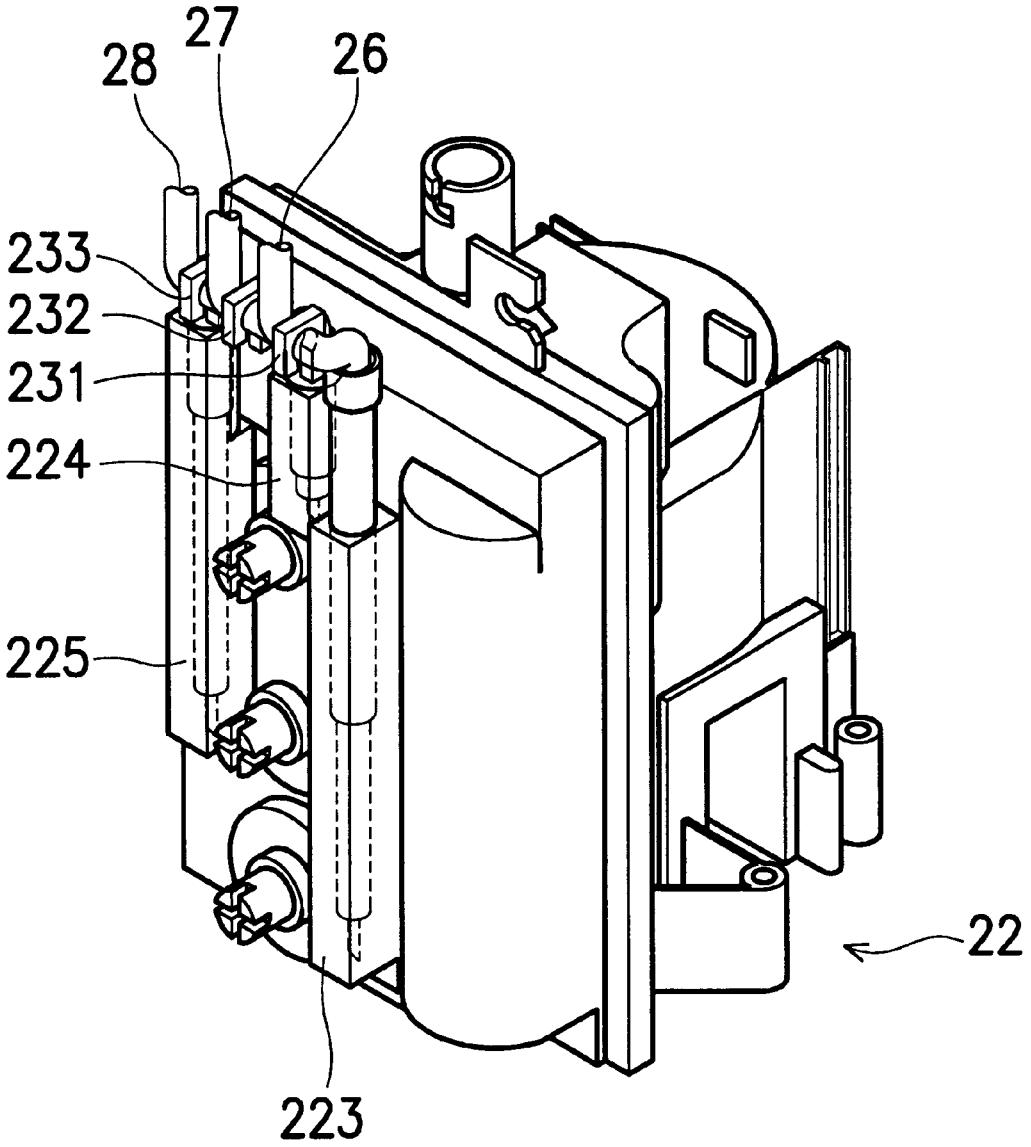
FIG. 7 shows a modified example of the second embodiment.

It is understood that the second embodiment can be modified by providing the hook-shaped portions on the collecting element as shown in FIG. 7 to prevent the separation of the wires from the fly back transformer.

Figure 8:
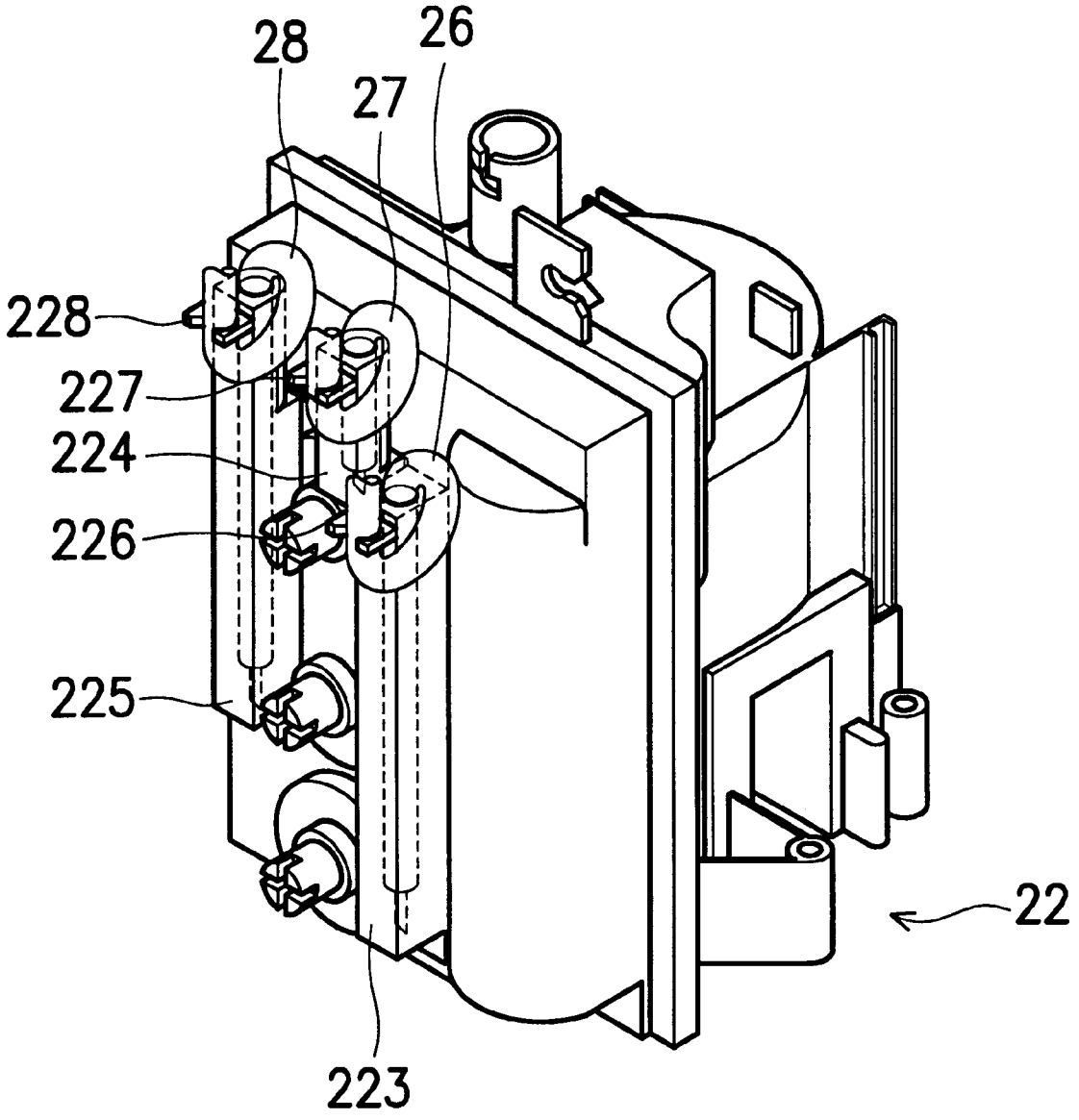
FIG. 8 is a perspective exploded diagram of a fly back transformer in accordance with a third embodiment of the present invention.

FIG. 8 shows a fly back transformer of a third embodiment of the present invention, in which no collecting element is used. The wires 26, 27, 28 are directly inserted into the sleeves 223, 224, 225 of the main body 22. Three pincers-shaped portions 226, 227, 228 are formed on the sleeves 223, 224, 225 to tightly hold the wires 26, 27, 28. Thus, a pull on the wires 26, 27, 28 does not separate them from the fly back transformer.

Figure 9:
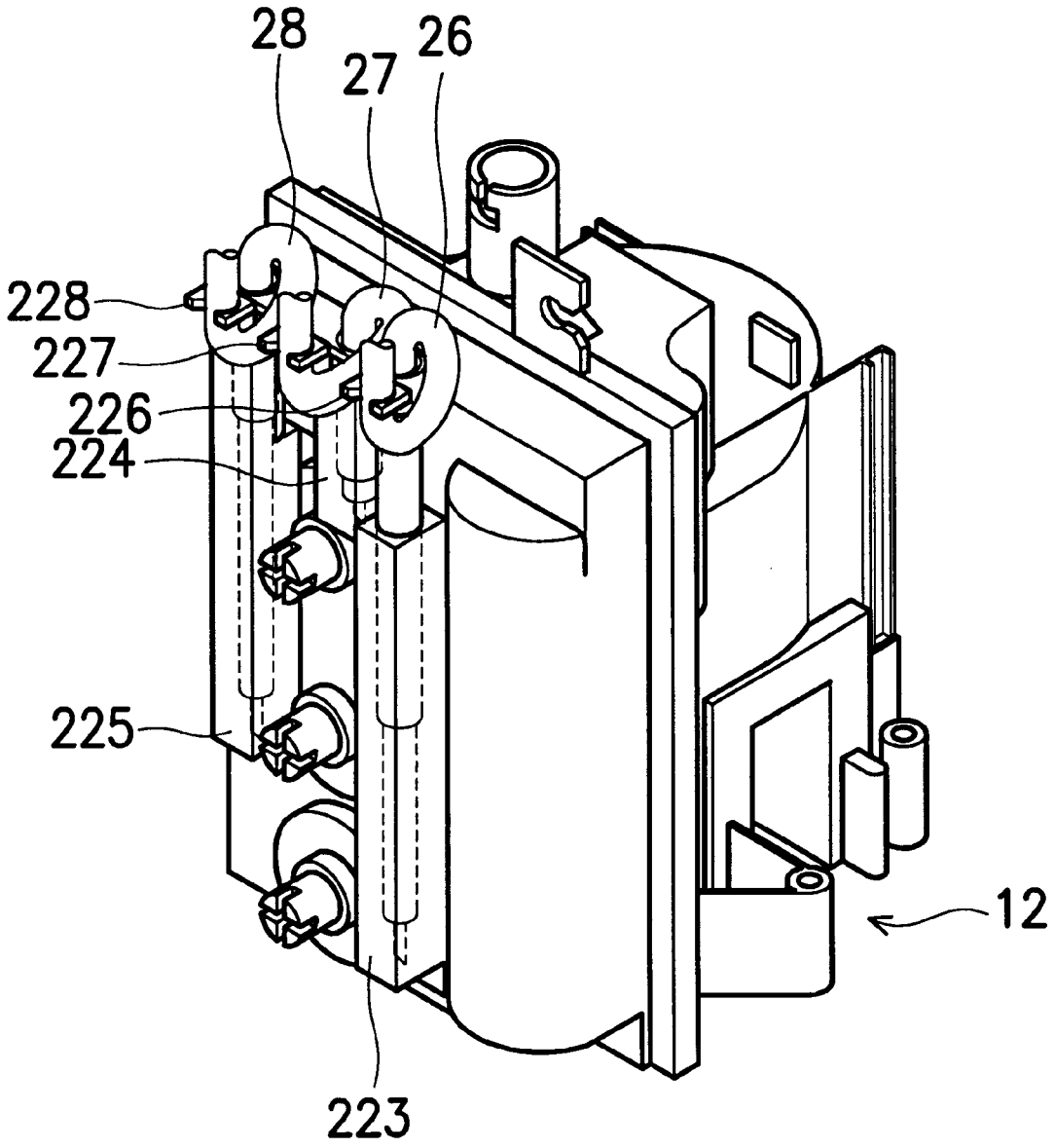
FIG. 9 shows a modified example of the third embodiment.

If a collecting element is added, then the third embodiment can be modified by providing pincers-shaped portions on the collecting element as shown in FIG. 9 to prevent the separation of the wires from the fly back transformer.

In sum, the present invention provides various fixing portions on the collecting element or main body of the fly back transformer to fix the wires, thereby solving the problem of the separation between the wires and the fly back transformer.

While the invention has been described by way of example and in terms of the preferred embodiment, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A fly back transformer, including:

a wire;

a collecting element having a tube for receiving the wire and a fixing portion for fixing the wire to the collecting element by twining; and a main body having a sleeve for receiving the tube with the wire disposed therein;

wherein the wire is electrically connected to the main body via the tube and sleeve.

2. A fly back transformer as claimed in claim 1, wherein the fixing portion is a protrusion and the wire is twined as a closed loop around the protrusion.

3. A fly back transformer as claimed in claim 2, wherein an opening is provided on the protrusion to receive the wire.

4. A fly back transformer as claimed in claim 2, wherein the protrusion has a retaining portion extending from the protrusion to keep the wire around the protrusion.

5. A fly back transformer as claimed in claim 1, wherein the fixing portion is hook-shaped to hook the wire.

6. A fly back transformer as claimed in claim 1, wherein the fixing portion is pincers-shaped to tightly hold the wire.

7. A fly back transformer, including:

a wire; and a main body having a sleeve for receiving the wire and a fixing portion for fixing the wire to the main body by twining;

wherein the wire is electrically connected to the main body via the sleeve.

8. A fly back transformer as claimed in claim 7, wherein the fixing portion is a protrusion and the wire is twined as a closed loop around the protrusion.

9. A fly back transformer as claimed in claim 8, wherein an opening is provided on the protrusion to receive the wire.

10. A fly back transformer as claimed in claim 8, wherein the protrusion has a retaining portion extending from the protrusion to keep the wire around the protrusion.

11. A fly back transformer as claimed in claim 7, wherein the fixing portion is hook-shaped to hook the wire.

12. A fly back transformer as claimed in claim 7, wherein the fixing portion is pincers-shaped to tightly hold the wire.

* * * * *